US010119079B2

(12) United States Patent
Fuji et al.

(10) Patent No.: US 10,119,079 B2
(45) Date of Patent: Nov. 6, 2018

(54) COMPOSITION FOR REMOVAL OF SULFUR-CONTAINING COMPOUNDS

(71) Applicant: KURARAY CO., LTD., Kurashiki-shi (JP)

(72) Inventors: Junichi Fuji, Chiyoda-ku (JP); Ryoko Miyazaki, Kamisu (JP); Takahiro Suzuki, Kamisu (JP)

(73) Assignee: KURARAY CO., LTD., Kurashiki-shi (JP)

( * ) Notice: Subject to any disclaimer, the term of this patent is extended or adjusted under 35 U.S.C. 154(b) by 45 days.

(21) Appl. No.: 15/126,191

(22) PCT Filed: Mar. 11, 2015

(86) PCT No.: PCT/JP2015/057114

§ 371 (c)(1),
(2) Date: Sep. 14, 2016

(87) PCT Pub. No.: WO2015/141535

PCT Pub. Date: Sep. 24, 2015

(65) Prior Publication Data

US 2017/0081597 A1 Mar. 23, 2017

(30) Foreign Application Priority Data

Mar. 17, 2014 (JP) ..... 2014-053181

(51) Int. Cl.
*C10G 29/24* (2006.01)
*C10G 29/20* (2006.01)
*C10L 3/10* (2006.01)

(52) U.S. Cl.
CPC ..... *C10G 29/24* (2013.01); *C10G 29/20* (2013.01); *C10L 3/103* (2013.01); *C10G 2300/202* (2013.01)

(58) Field of Classification Search
CPC .. C10G 29/20; C10G 29/24; C10G 2300/202; C10L 3/103
See application file for complete search history.

(56) References Cited

U.S. PATENT DOCUMENTS

| | | | | |
|---|---|---|---|---|
| 1,991,765 | A | 2/1935 | Marks | |
| 4,510,332 | A * | 4/1985 | Matsumoto | C07C 43/317 568/454 |
| 4,532,117 | A * | 7/1985 | Delaney | B01D 53/1425 210/764 |
| 4,680,127 | A | 7/1987 | Edmondson | |
| 4,774,071 | A | 9/1988 | Jeffrey et al. | |
| 4,781,901 | A | 11/1988 | Jeffrey | |
| 4,816,238 | A | 3/1989 | Jeffrey | |
| 4,871,468 | A | 10/1989 | Jeffrey | |
| 5,223,173 | A | 6/1993 | Jeffrey | |
| 5,284,635 | A | 2/1994 | Frederic | |
| 5,347,004 | A | 9/1994 | Rivers et al. | |
| 2002/0139717 | A1 | 10/2002 | Titley et al. | |
| 2011/0147272 | A1 | 6/2011 | Karas et al. | |
| 2012/0241361 | A1 | 9/2012 | Ramachandran et al. | |
| 2013/0004393 | A1 | 1/2013 | Menendez et al. | |
| 2013/0089460 | A1 | 4/2013 | Keenan et al. | |
| 2013/0090271 | A1 | 4/2013 | Keenan et al. | |

FOREIGN PATENT DOCUMENTS

| | | | |
|---|---|---|---|
| CN | 87103152 | A | 12/1987 |
| JP | 7-267890 | A | 10/1995 |
| JP | 2004-168663 | A | 6/2004 |
| JP | 2013-515818 | A | 5/2013 |
| WO | 2011/087540 | A2 | 7/2011 |

OTHER PUBLICATIONS

Longley, Jr., R. I. et al. (1954). Organic Syntheses, 34, 71.*
Extended European Search Report dated Sep. 22, 2017 in Patent Application No. 15764831.2.
Raymond I. Longley, et al., "Working with Hazardous Chemicals, 3-Methyl-1, 5-Pentanediol", Organic Syntheses, vol. 34, XP055403451, 1985, 4 pages.
Combined Office Action and Search Report dated Jun. 23, 2017 in Chinese Patent Application No. 201580014187.3 (with English translation of categories of cited documents).
D. D. Horaska, et al., "Acrolein Provides Benefits and Solutions to Offshore Oilfield-Production Problems," Oil and Gas Facilities, Aug. 2012, pp. 47-54.
International Search Report dated May 26, 2015 in PCT/JP2015/057114 Filed Mar. 11, 2015.
Office Action dated May 18, 2018 in European Patent Application No. 15 764 831.2.

* cited by examiner

*Primary Examiner* — Brian A McCaig
(74) *Attorney, Agent, or Firm* — Oblon, McClelland, Maier & Neustadt, L.L.P.

(57) ABSTRACT

Disclosed is a composition capable of removing safely and efficiently a sulfur-containing compound contained in a hydrocarbon, particularly hydrogen sulfide, an —SH group-containing compound, or a mixture thereof. Provided is a composition for removal of a sulfur-containing compound in a hydrocarbon, the sulfur-containing compound being hydrogen sulfide, an —SH group-containing compound or a mixture thereof: the composition containing a dialdehyde having 6 to 16 carbon atoms as an active ingredient.

10 Claims, No Drawings

COMPOSITION FOR REMOVAL OF SULFUR-CONTAINING COMPOUNDS

TECHNICAL FIELD

The present invention relates to a composition for removal, or reduction of a concentration, of sulfur-containing compounds in hydrocarbons, typically hydrogen sulfide, an —SH group-containing compound, or a mixture thereof. In detail, the present invention relates to a composition for removal of sulfur-containing compounds (typically hydrogen sulfide) contained in fossil fuels, refined petroleum products, and so on, for example, natural gas, liquefied natural gas, sour gas, crude oil, naphtha, heavy aromatic naphtha, gasoline, kerosene, diesel oil, light oil, heavy oil, FCC slurry asphalt, oil field concentrates, etc., and to a method for removal of sulfur-containing compounds (typically hydrogen sulfide) using the composition.

BACKGROUND ART

Hydrocarbons, such as fossil fuels, refined petroleum products, etc., for example, natural gas, liquefied natural gas, sour gas, crude oil, naphtha, heavy aromatic naphtha, gasoline, kerosene, diesel oil, light oil, heavy oil, FCC slurry, asphalt, oil field concentrates, etc., often contain sulfur-containing compounds, such as hydrogen sulfide or a variety of —SH group-containing compounds (typically various mercaptans), etc. Toxicity of hydrogen sulfide is well known, and in the industry dealing with fossil fuels or refined petroleum products, in order to reduce the content of hydrogen sulfide to a safe level, considerable costs and efforts are exerted. For example, as for pipeline gas, what the content of hydrogen sulfide does not exceed 4 ppm is required as a lot of regulation values. In addition, hydrogen sulfide and a variety of —SH group-containing compounds (typically various mercaptans) tend to be released into a vapor space because of volatility thereof. In that case, their offensive odors are of a problem in storage places and/or surrounding places thereof and through pipelines and shipping systems used for transportation of the aforementioned hydrocarbons.

From the foregoing viewpoints, in large-scale facilities dealing with fossil fuels or refined petroleum products, systems for treating a hydrogen sulfide-containing hydrocarbon or hydrocarbon fluid are commonly installed. These systems include an absorption tower coming into contact with a hydrocarbon or a hydrocarbon fluid and filled with an alkanolamine, PEG, a hindered amine, etc., which absorb a sulfur-containing compound, such as hydrogen sulfide, or a variety of —SH group-containing compounds (typically various mercaptans), carbon dioxide in some case, and which are capable of being regenerated and used in the treatment system after absorption.

Meanwhile, it has been known for long that a triazine is used for removal of hydrogen sulfide in a hydrocarbon. However, there is involved such a defect that the triazine cannot be used unless used under basic conditions (the triazine is decomposed under neutral to acidic conditions).

It has also been known for long that an aldehyde compound is used for removal of hydrogen sulfide in a hydrocarbon. Specifically, PTL 1 discloses the reaction of an aldehyde compound with hydrogen sulfide, particularly the reaction of a formaldehyde aqueous solution with hydrogen sulfide in an aqueous solution at a pH ranging from 2 to 12. Since then, there have been made many reports regarding the use of an aldehyde compound for the purpose of removal of hydrogen sulfide. For example, in PTL 2, a water-soluble aldehyde, such as formaldehyde, glyoxal, glutaraldehyde, etc., is used in a form of an aqueous solution as a hydrogen sulfide removing agent in a hydrocarbon.

In the case where the hydrogen sulfide removing agent that is an aqueous solution is merely added to the hydrocarbon, an improvement is demanded from the viewpoint of mixing. For example, PTL 3 mentions that the removal efficiency of hydrogen sulfide can be improved by adding an emulsifying agent, such as sorbitan sesquiolate, to the aforementioned aldehyde. In addition, in PTL 4, in order to efficiently remove hydrogen sulfide in a heavy oil, the hydrogen sulfide removing agent that is an aqueous solution and the heavy oil are emulsified in an injection system including a static mixer.

In addition, in the case of using, as the hydrogen sulfide removing agent, the aforementioned water-soluble aldehyde in a form of an aqueous solution, there is a concern that corrosion of equipment is caused due to the presence of an organic carboxylic acid by oxidation of formaldehyde, glyoxal, or glutaraldehyde in the aqueous solution. From this viewpoint, in PTLs 5 and 6, it is proposed to jointly use, as a corrosion inhibitor, a phosphate salt, such as $LiH_2PO_4$, $NaH_2PO_4$, $Na_2HPO_4$, $KH_2PO_4$, $K_2HPO_4$, etc., a phosphate ester, a thiophosphate, a thioamine, or the like.

However, it is well known that formaldehyde is a mutagenic substance. In addition, as in the Test Examples as described later, glutaraldehyde has toxicity and is hardly decomposable, and therefore, these aldehydes involve problems regarding safety at the time of handling and influence on environment.

Meanwhile, PTL 2 discloses use of not only the aforementioned water-soluble aldehyde but also acrolein with higher organicity as the hydrogen sulfide removing agent. In SPE Annual Technical Conference and Exhibition SPE146080, held in Denver, Colo. State, U.S.A. on Oct. 30 to Nov. 2, 2011, an announcement regarding removal of hydrogen sulfide with acrolein as an active ingredient is also made. However, the acrolein has strong toxicity and is a compound whose concentration is strictly controlled from the standpoints of occupational safety and environmental safety, and therefore, there is involved such a problem that attention is required for handling.

CITATION LIST

Patent Literature

PTL 1: U.S. Pat. No. 1,991,765
PTL 2: U.S. Pat. No. 4,680,127
PTL 3: U.S. Pat. No. 5,284,635
PTL 4: WO 2011/087540 A
PTL 5: US 2013/090271 A
PTL 6: US 2013/089460 A

Non-Patent Literature

NPL 1: SPE Annual Technical Conference and Exhibition SPE146080, 2011; http://dx.doi.org/10.2118/146080-MS

SUMMARY OF INVENTION

Technical Problem

As mentioned previously, in order to use the conventionally proposed aqueous solution of a water-soluble aldehyde as the removing agent of hydrogen sulfide contained in a hydrocarbon or a hydrocarbon fluid, it was necessary to disperse the aqueous solution of a water-soluble aldehyde in the hydrocarbon by some means, or to inhibit the corrosion to be caused by the aqueous solution per se, and other additives or apparatus became needed. Thus, a still more improvement is desired.

Then, an object of the present invention is to provide a composition capable of removing safely and efficiently a sulfur-containing compound contained in a hydrocarbon, particularly hydrogen sulfide, an —SH group-containing compound, or a mixture thereof.

Solution to Problem

The present invention is as follows.

[1] A composition for removal of a sulfur-containing compound in a hydrocarbon, the sulfur-containing compound being hydrogen sulfide, an —SH group-containing compound or a mixture thereof:

the composition containing a dialdehyde having 6 to 16 carbon atoms as an active ingredient.

[2] The composition of [1], wherein the dialdehyde is 1,9-nonanedial and/or 2-methyl-1,8-octanedial.

[3] The composition of [1] or [2], wherein the hydrocarbon that is subject to the removal of a sulfur-containing compound is one or more selected from the group consisting of natural gas, liquefied natural gas, sour gas, crude oil, naphtha, heavy aromatic naphtha, gasoline, kerosene, diesel oil, light oil, heavy oil, FCC slurry, asphalt, and oil field concentrates.

[4] A method for removing a sulfur-containing compound in a hydrocarbon including using the composition of any of [1] to [3], the sulfur-containing compound being hydrogen sulfide, an —SH group-containing compound, or a mixture thereof.

[5] The method of [4], including further using a nitrogen-containing compound.

[6] The method of [4] or [5], wherein the hydrocarbon is one or more selected from the group consisting of natural gas, liquefied natural gas, sour gas, crude oil, naphtha, heavy aromatic naphtha, gasoline, kerosene, diesel oil, light oil, heavy oil, FCC slurry, asphalt, and oil field concentrates.

[7] The method of any of [4] to [6], wherein a use amount of the composition of any of [1] to [3] is in the range of from 1 to 10,000 ppm relative to the mass of the hydrocarbon.

[8] The method of any of [4] to [7], wherein the composition of any of [1] to [3] and the hydrocarbon are brought into contact with each other at from 20° C. to 200° C.

[9] Use of the composition of any of [1] to [3], for removal of a sulfur-containing compound that is hydrogen sulfide, an —SH group-containing compound, or a mixture thereof, in a hydrocarbon.

Advantageous Effects of Invention

In view of the fact that the composition of the present invention includes, as an active ingredient, a dialdehyde having 6 to 16 carbon atoms, for example, 1,9-nonanedial and/or 2-methyl-1,8-octanedial or 3-methylglutaraldehyde, it is excellent in a removal performance of a sulfur-containing compound, particularly hydrogen sulfide, an —SH group-containing compound, or a mixture thereof, in a hydrocarbon. In addition, as compared with other aldehydes which have hitherto been used as the hydrogen sulfide removing agent, particularly the composition of the present invention including 1,9-nonanedial and/or 2-methyl-1,8-octanedial as an active ingredient is low in toxicity and biodegradable, and therefore, it does not adversely affect the environment and is excellent in safety on handling and also excellent in heat resistance. Therefore, on storage, transportation, or the like of the hydrocarbon, even by using the composition of the present invention, corrosiveness of equipment is low.

DESCRIPTION OF EMBODIMENTS

In the present specification, the hydrocarbon that is subject to the use of the composition of the present invention may be a gas, a liquid, a solid, or a mixture thereof. Typically, examples thereof include fossil fuels, refined petroleum products, and so on, for example, natural gas, liquefied natural gas, sour gas, crude oil, naphtha, heavy aromatic naphtha, gasoline, kerosene, diesel oil, light oil, heavy oil, FCC slurry, asphalt, oil field concentrates, etc., and arbitrary combinations thereof. However, the hydrocarbon is not limited thereto.

In the present invention, the sulfur-containing compound that may be contained in the hydrocarbon and which is subject to the removal by using the composition of the present invention is hydrogen sulfide, an —SH group-containing compound, or a mixture thereof. Here, examples of the —SH group-containing compound include sulfur-containing compounds classified as a mercaptan represented by a chemical formula "R—SH", for example, those in which R is an alkyl group, inclusive of methyl mercaptan, ethyl mercaptan, propyl mercaptan, isopropyl mercaptan, n-butyl mercaptan, isobutyl mercaptan, sec-butyl mercaptan, tert-butyl mercaptan, and n-amyl mercaptan; those in which R is an aryl group, inclusive of phenyl mercaptan; those in which R is an aralkyl group, inclusive of benzyl mercaptan; and the like. However, the sulfur-containing compound is not limited thereto.

The composition of the present invention is characterized, by containing a dialdehyde having 6 to 16 carbon atoms as an active ingredient. The dialdehyde having 6 to 16 carbon atoms is suitably an aliphatic dialdehyde. Examples thereof include methylglutaraldehyde, 1,6-hexanedial, ethylpentanedial, 1,7-heptanedial, methylhexanedial, 1,8-octanedial, methylheptanedial, dimethylhexanedial, ethylhexanedial, 1,9-nonanedial, methyloctanedial, ethylheptanedial, 1,10-decanedial, dimethyloctanedial, ethyloctanedial, dodecanedial, hexadecanedial, 1,2-cyclohexane dicarboaldehyde, 1,3-cyclohexane dicarboaldehyde, 1,4-cyclohexane dicarboaldehyde, 1,2-cyclooctane dicarboaldehyde, 1,3-cyclooctane dicarboaldehyde, 1,4-cyclooctane dicarboaldehyde, 1,5-cyclooctane dicarboaldehyde, 4,7-dimethyl-1,2-cyclooctane dicarboaldehyde, 4,7-dimethyl-1,3-cyclooctane dicarboaldehyde, 2,6-dimethyl-1,3-cyclooctane dicarboaldehyde, 2,6-dimethyl-1,4-cyclooctane dicarboaldehyde, 2,6-dimethyl-1,5-cyclooctane dicarboaldehyde, octahydro-4,7-methano-1H-indene-2,5-dicarboaldehyde, and the like. Of those, 3-methylglutaraldehyde, 1,9-nonanedial, and 2-methyl-1,8-octanedial are preferred. From the viewpoint that the composition of the present invention may be provided with low toxicity, biodegradability, safety on handling, heat resistance, and so on, it is more preferred that the composition of the present invention contains at least one of 1,9-nonanedial and 2-methyl-1,8-octanedial as an active ingredient.

In the case where the composition of the present invention contains at least one of 1,9-nonanedial and 2-methyl-1,8-octanedial as an active ingredient, though the active ingredient may be 1,9-nonanedial solely or 2-methyl-1,8-octanedial solely, from the viewpoint of easiness of industrial availability, the active ingredient is especially preferably a form of a mixture of 1,9-nonanedial and 2-methyl-1,8-octanedial. Though a mixing ratio of such a mixture of 1,9-nonanedial and 2-methyl-1,8-octanedial is not particularly limited, in general, a mass ratio of 1,9-nonanedial and 2-methyl-1,8-octanedial is preferably 99/1 to 1/99, more preferably 95/5 to 5/95, still more preferably 90/10 to 45/55, and especially preferably 90/10 to 55/45.

All of 1,9-nonanedial and 2-methyl-1,8-octanedial are a known substance and may be produced by a method that is known per se (for example, methods described in Japanese Patent No. 2857055, JP 62-61577 B, and the like) or methods conforming thereto. In addition, commercially available products may also be used. 3-Methylglutaraldehyde (MGL) is a known substance, too and may be produced by a known method (for example, methods described in *Organic Syntheses*, Vol. 34, p. 29 (1954) and *Organic Syntheses*, Vol. 34, p. 71 (1954), and the like) or methods conforming thereto.

1,9-Nonanedial and/or 2-methyl-1,8-octanedial have/has a sterilizing action equal to or more than glutaraldehyde, are/is low in oral toxicity, excellent in biodegradability, high in safety, and excellent in heat resistance, and have/has storage stability.

A content proportion of the dialdehyde that is an active ingredient in the composition of the present invention may be properly set according to the mode of use and is generally 1 to 100% by mass. From the viewpoint of cost performance, the content proportion of the dialdehyde is preferably 5 to 100% by mass, and more preferably 5 to 95% by mass.

The production method of the composition of the present invention is not particularly limited, and a method that is known per se or a method conforming thereto may be adopted. The composition of the present invention may be, for example, produced by a method in which a dialdehyde, suitably at least one selected from 3-methylglutaraldehyde, 1,9-nonanedial, and 2-methyl-1,8-octanedial, and especially suitably a mixture of 1,9-nonanedial and 2-methyl-1,8-octanedial is added and mixed with an arbitrary component as described later, if desired, or other method.

Though the composition of the present invention is suitably a liquid, it may also be a solid, such as a powder, a granule, etc., in a form to be properly supported on a carrier or the like, depending upon the form to be used for removal of the sulfur-containing compound in the hydrocarbon.

In the method of removing the sulfur-containing compound in the hydrocarbon with the composition of the present invention, in addition to the composition of the present invention, an aldehyde compound that has hitherto been known as the hydrogen sulfide removing agent, such as formaldehyde, glyoxal, glutaraldehyde, acrolein, etc., may be properly added and used.

In addition, in the method of removing the sulfur-containing compound in the hydrocarbon with the composition of the present invention, a nitrogen-containing compound may be further added within the range where the effect of the present invention is much more improved or not impaired. Examples of such a nitrogen-containing compound include α-amino ether compounds, such as N,N'-oxybis(methylene)bis(N,N-dibutylamine), N,N'-(methylenebis(oxy)bis(methylene))bis(N,N-dibutylamine), 4,4'-oxybis(methylene)dimorpholine, bis(morpholinomethoxy) methane, 1,1'-oxybis(methylene)dipiperidine, bis(piperidinomethoxy) methane, N,N'-oxybis(methylene)bis(N,N-dipropylamine), N,N'-(methylenebis(oxy)bis(methylene))bis(N,N-dipropylamine), 1,1'-oxybis(methylene)dipyrrolidine, bis(pyrrolidinomethoxy)methane, N,N'-oxybis(methylene)bis(N,N-diethylamine), N,N'-(methylenebis(oxy)bis(methylene))bis(N,N-diethylamine), etc.; alkoxy-hexahydrotriazine compounds, such as 1,3,5-trimethoxypropyl-hexahydro-1,3,5-triazine, 1,3,5-trimethoxyethyl-hexahydro-1,3,5-triazine, 1,3,5-tri(3-ethoxypropyl)-hexahydro-1,3,5-triazine, 1,3,5-tri(3-isopropoxypropyl)-hexahydro-1,3,5-triazine, 1,3,5-tri(3-butoxypropyl)-hexahydro-1,3,5-triazine, 1,3,5-tri(5-methoxypentyl)-hexahydro-1,3,5-triazine, etc.; alkyl-hexahydrotriazine compounds, such as 1,3,5-trimethyl-hexahydro-1,3,5-triazine, 1,3,5-triethyl-hexahydro-1,3,5-triazine, 1,3,5-tripropyl-hexahydro-1,3,5-triazine, 1,3,5-tributyl-hexahydro-1,3,5-triazine, etc.; hydroxyalkyl-hexahydrotriazine compounds, such as 1,3,5-tri(hydroxymethyl)-hexahydro-1,3,5-triazine, 1,3,5-tri(2-hydroxyethyl)-hexahydro-1,3,5-triazine, 1,3,5-tri(3-hydroxypropyl)-hexahydro-1,3,5-triazine, etc.; monoamine compounds, such as monomethylamine, monoethylamine, dimethylamine, dipropylamine, trimethylamine, triethylamine, tripropylamine, monomethanolamine, dimethanolamine, trimethanolamine, diethanolamine, triethanolamine, monoisopropanolamine, dipropanolamine, diisopropanolamine, tripropanolamine, N-methylethanolamine, dimethyl(ethanol)amine, methyldiethanolamine, dimethylaminoethanol, ethoxyethoxyethanol tert-butylamine, etc.; diamine compounds, such as aminomethylcyclopentylamine, 1,2-cyclohexanediamine, 1,4-butanediamine, 1,5-pentanediamine, 1,6-hexanediamine, bis(tert-butylaminoethoxy)ethane, etc.; imine compounds; imidazoline compounds; hydroxyaminoalkyl ether compounds; morpholine compounds; pyrrolidone compounds; piperidone compounds; alkylpyridine compounds; 1H-hexahydroazepine; reaction products between an alkylenepolyamine and formaldehyde, such as a reaction product between ethylenediamine and formaldehyde, etc.; polyvalent metal chelate compounds of an aminocarboxylic acid; quaternary ammonium salt compounds, such as benzyl(cocoalkyl)(dimethyl) quaternary ammonium chloride, di(cocoalkyl)dimethyl ammonium chloride, di(tallow alkyl)dimethyl quaternary ammonium chloride, di(hydrogenated tallow alkyl)dimethyl quaternary ammonium chloride, dimethyl(2-ethylhexyl)(tallow alkyl) ammonium methyl sulfate, (hydrogenated tallow alkyl)(2-ethylhexyl)dimethyl quaternary ammonium methyl sulfate, etc.; polyethyleneimine, polyallylamine, polyvinylamine; amino carbinol compounds; aminal compounds; bisoxazolidine compounds; and the like. These compounds may be used solely or in combination of two or more thereof.

In the case where such nitrogen-containing compound is added to the hydrocarbon, there is a concern that $NO_x$ is generated in refining, thereby applying a load to the environment. Taking into consideration this matter, it is more preferred that the nitrogen-containing compound is not added.

As an example of preferred embodiments of the present invention, the treatment is performed by adding the composition of the present invention in a sufficient amount for achieving the removal of the sulfur-containing compound (hydrogen sulfide, an —SH group-containing compound, or a mixture thereof). In the method of removing the sulfur-containing compound in the hydrocarbon with the composition of the present invention, in general, the composition of the present invention is added in an amount preferably ranging from 1 to 10,000 ppm relative to the mass of the hydrocarbon. A temperature at which the composition of the present invention is added to and brought into contact with the hydrocarbon to perform the treatment is preferably in the range of from 20° C. to 200° C. In addition, the composition of the present invention may be used upon being dissolved in an appropriate solvent, such as toluene, xylene, heavy aromatic naphtha, petroleum distillate; a monoalcohol or diol having 1 to 10 carbon atoms, e.g., methanol, ethanol, ethylene glycol, polyethylene glycol, etc.

In the method of removing the sulfur-containing compound in the hydrocarbon with the composition of the present invention, in the case where the hydrocarbon is a liquid, the composition of the present invention may be added through known means, such as pouring in a storage tank thereof, a pipeline for transportation, a distillation tower for refining, etc., or the like. In the case where the hydrocarbon is a gas, means, for example, installing the composition of the present invention so as to bring it into contact with a gas, allowing a gas to pass through an absorption tower filled with the composition of the present invention, or the like, may be taken.

EXAMPLES

The present invention is hereunder described in more detail with reference to Examples and so on, but it should not be construed that the present invention is limited to these Examples.

Production Example 1

[Production of Mixture of 1,9-Nonanedial (NL) and 2-Methyl-1,8-octanedial (MOL)]

A mixture of 1,9-nonanedial (hereinafter referred to as NL) and 2-methyl-1,8-octanedial (hereinafter referred to as MOL) was produced according to a method described in Japanese Patent No. 2857055. A mass ratio of NL and MOL in the mixture was NL/MOL=85/15.

Production Example 2

[Production of 3-Methylglutaraldehyde (MGL)]

A compound of 3-methylglutaraldehyde (hereinafter referred to as MGL) was produced according to a method described in a literature (*Organic Syntheses*, Vol. 34, p. 29 (1954)). From the viewpoint of stability, this compound was diluted in a form of a 50% by mass aqueous solution and stored.

Example 1

In a three-neck flask having a capacity of 300 mL and equipped with a thermometer, a dropping funnel, and a three-way cock, 4.40 g (50 mmol) of iron sulfide (manufactured by Wako Pure Chemical Industries, Ltd.) was charged, and 50.0 g (100 mmol) of a 20% sulfuric acid aqueous solution (manufactured by Wako Pure Chemical Industries, Ltd.) was added dropwise from the dropping funnel at 21° C. over 120 minutes, thereby generating hydrogen sulfide.

Meanwhile, in a three-neck flask having a capacity of 5 L and equipped with a thermometer and a three-way cock, the inside of which had been purged with nitrogen, 500 g of kerosene (manufactured by Wako Pure Chemical Industries, Ltd.) was charged and kept at 21° C., and the above-generated hydrogen sulfide was blown through the three-way cock, thereby absorbing onto the kerosene. Thereafter, the three-neck flask was hermetically sealed and allowed to stand at the same temperature for 60 minutes, thereby rendering the hydrogen sulfide in an equilibrium state between liquid-phase and gas-phase. Thereafter, a concentration of hydrogen sulfide in the gas phase in the inside of the three-neck flask was measured according to a hydrogen sulfide measurement method as described later and found to be 510 ppm.

The mixture of NL/MOL=85/15 obtained in Production Example 1 was added to the kerosene which had been rendered in an equilibrium state between liquid-phase and gas-phase within the three-neck flask by blowing the hydrogen sulfide and absorbing it thereonto, in a concentration of 850 ppm relative to the mass of kerosene, and immediately thereafter, the contents were stirred at 21° C. under hermetic sealing at 400 rpm. The concentration of hydrogen sulfide in the gas phase in the inside of the three-neck flask was measured in the same manner as described above at an elapsed time of 60 minutes, 90 minutes, and 120 minutes, respectively after the addition of NL/MOL. The results are shown in Table 1. It is noted that the concentration of hydrogen sulfide in the gas phase in the inside of the three-neck flask was conspicuously reduced.

<Hydrogen Sulfide Measurement Method>

Using a Kitagawa gas detector tube system (manufactured by Komyo Rikagaku Kogyo K.K.; used by installing a hydrogen sulfide gas detector tube "120-ST" in a gas aspirating pump "AP-20"), 50 mL of a gas phase part of the inside of the flask was sampled, and a concentration value in the detector tube was defined as a hydrogen sulfide concentration of the gas phase.

TABLE 1

Hydrogen sulfide concentration in gas phase

| Elapsed time (min) | Hydrogen sulfide concentration in gas phase (ppm) | Rate of reduction (%) |
|---|---|---|
| 0 | 510 | — |
| 60 | 240 | 53 |
| 90 | 150 | 71 |
| 120 | 95 | 81 |

Example 2

In a 100-mL autoclave equipped with a thermometer and a stirrer, 30 mL of a crude oil collected in Japan was charged and stirred until an $H_2S$ concentration of a gas phase part became constant. Thereafter, the concentration was measured with RX-517 (manufactured by Riken Kiki Co., Ltd.) and found to be 2,800 ppm. Subsequently, a composition liquid prepared by mixing PEG-200 and NL/MOL in a mass ratio of 1/1 was added in a concentration of 1% by mass relative to the crude oil. At this time, the addition amount of NL/MOL was 0.6 mmol, and the presence amount of $H_2S$ within the apparatus was 0.05 mmol. Thereafter, the inside of the apparatus was subjected to temperature rise to 80° C. while stirring at 800 rpm, and the contents were allowed to react with each other for 5 hours. After the reaction, the reaction mixture was cooled to room temperature, an $H_2S$ concentration of the gas phase part was measured and found to be 2 ppm, and a removal efficiency was 99.9%.

Example 3

In a 100-mL autoclave equipped with a thermometer and a stirrer, 30 mL of a crude oil collected in Japan was charged and stirred until an $H_2S$ concentration of a gas phase part became constant. Thereafter, the concentration was measured with RX-517 (manufactured by Riken Kiki. Co., Ltd.) and found to be 2,580 ppm. Subsequently, a 50% by mass MGL aqueous solution was added in a concentration of 1% by mass relative to the crude oil. At this time, the addition amount of MGL was 0.9 mmol, and the presence amount of $H_2S$ within the apparatus was 0.05 mmol. Thereafter, the inside of the apparatus was subjected to temperature rise to 80° C. while stirring at 800 rpm, and the contents were allowed to react with each other for 5 hours. After the reaction, the reaction mixture was cooled to room temperature, an $H_2S$ concentration of the gas phase part was measured and found to be 70 ppm, and a removal efficiency was 97.3%.

Comparative Example 1

In a 100-mL autoclave equipped with a thermometer and a stirrer, 30 mL of a crude oil collected in Japan was charged and stirred until an $H_2S$ concentration of a gas phase part became constant. Thereafter, the concentration was measured with RX-517 (manufactured by Riken Kiki Co., Ltd.) and found to be 2,714 ppm. Subsequently, a 50% by mass glutaraldehyde aqueous solution was added in a concentration of 1% by mass relative to the crude oil. At this time, the addition amount of glutaraldehyde was 1.0 mmol, and the presence amount of $H_2S$ within the apparatus was 0.05 mmol. Thereafter, the inside of the apparatus was subjected to temperature rise to 80° C. while stirring at 800 rpm, and the contents were allowed to react with each other for 5 hours. After the reaction, the reaction mixture was cooled to room temperature, an $H_2S$ concentration of the gas phase part was measured and found to be 100 ppm, and a removal efficiency was 96.3%.

Comparative Example 2

In a 100-mL autoclave equipped with a thermometer and a stirrer, 30 mL of a crude oil collected in Japan was charged and stirred until an $H_2S$ concentration of a gas phase part became constant. Thereafter, the concentration was measured with RX-517 (manufactured by Riken Kiki Co., Ltd.) and found to be 2,600 ppm. Subsequently, a 40% by mass glyoxal aqueous solution (manufactured by Wako Pure Chemical Industries, Ltd.) was added in a concentration of 1% by mass relative to the crude oil. At this time, the addition amount of glyoxal was 1.8 mmol, and the presence amount of $H_2S$ within the apparatus was 0.04 mmol. Thereafter, the inside of the apparatus was subjected to temperature rise to 80° C. while stirring at 800 rpm, and the contents were allowed to react with each other for 5 hours. After the reaction, the reaction mixture was cooled to room temperature, an $H_2S$ concentration of the gas phase part was measured and found to be 498 ppm, and a removal efficiency was 80.8%.

Test Example 1

With respect to NL, MOL, and glutaraldehyde, measurement of oral toxicity, toxicity test on algae, bactericidal test on sludge, and biodegradability test were performed. The test methods and results are as follows.

<Oral Toxicity>

A test substance which had been emulsified and dispersed in a 2%-gum arabic aqueous solution (containing 0.5%-Tween 80) was compulsorily administered in a 6-week-old male CRj:CD(SD) rat once a day for 14 days by using an oral sonde. A body weight variation and a general state during the administration period were observed. The rat was fasted for one day from the final administration date (drinking was freely taken), and on the day after final administration, taking a blood sample (for various blood tests) and mass measurement of major organs were performed. In addition, with respect to the liver, kidney, spleen, and testis, a histopathological examination (optical microscopic observation of HE-stained thin sliced tissue piece) was also carried out. A dose was set to 1,000, 250, 60, 15, and 0 mg/kg/day (administration liquid volume=1 mL/100 g-body weight/day), respectively, and five animals were used for each dosage.

Test Substances:

(1) NL (GC purity: 99.7%)

(2) Glutaraldehyde (water content: 101 ppm, GC purity: 99.8%)

As a result of the test, with respect to NL, no fatal case was admitted even at the highest dose of 1,000 mg/kg/day. NL is not corresponding to a "deleterious substance". A maximum no-effect level (NOEL) under the present test conditions is shown in Table 2.

TABLE 2

Results of oral toxicity test

| Test substance | NOEL |
|---|---|
| NL | 250 mg/kg |
| Glutaraldehyde | 5 mg/kg |

<Algae Test>

An alga growth inhibition test of a test substance was carried out with reference to OECD Test Guidelines No. 201. That is, each of the following test substances was diluted with a test medium to a prescribed dosage. A liquid suspension of algae which had been grown to an exponential growth phase by preculture was added in an initial concentration of $1\times10^4$ cells/mL. The liquid suspension was subjected to shaking culture at 23° C. using a light irradiation-type bio shaker (BR-180LF, manufactured by Taitec Corporation), the number of algae cells at an elapsed time of 24, 48, and 72 hours, respectively after the start of the test was counted with a flow cytometer (Cell Lab Quant SC, manufactured by Beckman Coulter, Inc.), and a growth ratio at each test dosage was calculated while defining a growth ratio of the normal control as 100%. In addition, $ErC_{50}$ was calculated according to an equation of an approximate curve of a graph plotting a growth inhibition ratio. Potassium dichromate was used as a standard substance.

Algae: *Pseudokirchneriella subcapitata*

Test Substances:

(1) Mixture of NL and MOL (GC purity: 98.7%, NL/MOL=59/41)

(2) Glutaraldehyde (water content: 101 ppm, GC purity: 99.8%)

Dosage of Test Substance:

Each of the test substance (1) and the test substance (2): 100, 32, 10, 3.2, 1, 0.32 mg/L (common ratio: $\sqrt{10}$), and 0 mg/L (normal control)

Standard substance: 3.2, 1, 0.32 mg/L, and 0 mg/L (normal control)

In the present test, in view of the fact that $ErC_{50}$ of potassium dichromate (standard substance) at an elapsed time of 72 hours was 1.3 mg/L, and the growth ratio of the normal control at an elapsed time of 72 hours was 93.0%, it was concluded that the present test was operated normally. The test results are shown in Table 3.

TABLE 3

| Results of toxicity test on algae | |
|---|---|
| Test substance | $ErC_{50}$ (72 hr) |
| NL/MOL (mass ratio: 59/41) | 28.2 mg/L |
| Glutaraldehyde | 9.0 mg/L |

<Bactericidal Test on Sludge>

To a synthetic sewer water prepared by dissolving 5 g of each of glucose, peptone, and monopotassium dihydrogen phosphate in one liter of water and adjusting the pH at 7.0±1.0 with sodium hydroxide, a sludge of the sewage treatment plant located in the Mizushima district, Kurashiki-shi, Okayama Prefecture, Japan was added in an amount of 30 ppm as converted to dry mass, thereby preparing a bacterial culture. Meanwhile, a test substance was diluted with distilled water on a scale of one to ten in a final concentration of 1,000 to 0.004 ppm (common ratio=4) on a 24-well microplate, thereby preparing test solutions. Two wells were used for every concentration. As a comparison target, (distilled water+bacterial culture) was defined as "bacterial culture blank", and distilled water alone was defined as "blank".

The above-prepared bacterial culture and test solution were mixed in a volume ratio of 1/1, and the mixture was allowed to stand within a thermostatic tank at ambient temperature (about 25° C.) for 24 hours and 48 hours, respectively. A level of sludge influence at each concentration of the test substance was visually observed by means of the MTT method. An MTT reagent is converted by mitochondria as a microorganism in the sludge to form formazan, thereby developing a blue color. In the case where the microorganism dies out, the foregoing reaction does not occur, and the reagent shows yellow.

Test Substances:

(1) Mixture of NL and MOL (GC purity: 98.7%, NL/MOL=59/41)

(2) Glutaraldehyde (water content: 101 ppm, GC purity: 99.8%)

The results are shown in Table 4.

TABLE 4

| Results of bactericidal test on sludge | |
|---|---|
| Test substance | Sterilizing concentration |
| NL/MOL (mass ratio: 59/41) | 250 ppm |
| Glutaraldehyde | 63 ppm |

<Biodegradability Test>

A degradability test of a test substance was carried out with reference to the test methods of OECD Test Guidelines 301C and JIS K6950 (ISO 14851). That is, 300 mL of an inorganic medium solution and 9 mg (30 ppm) of activated sludge obtained on the day of the start of the test from the sewage treatment plant located in the Mizushima district, Kurashiki-shi, Okayama Prefecture, Japan were charged into a culture bottle. In view of the fact that both of the test substances have a sterilizing action, an influence on the sludge was considered, and a biodegradability test was performed at two concentrations of a high-concentration group: 30 mg (100 ppm) of test substance and a low-concentration group: 9 mg (30 ppm) of test substance.

Test Substances:

(1) Mixture of NL and MOL (GC purity: 98.7%, NL/MOL=59/41)

(2) Glutaraldehyde (water content: 101 ppm, GC purity: 99.8%)

After culture using a coulometer (3001A Type, manufactured by Ohkura Electric Co., Ltd.) at 25° C. for 28 days, a biodegradation ratio was calculated from an amount of oxygen consumed for the decomposition of the test substance and a theoretical oxygen demand determined from a structural formula of the test substance. As a biodegradable standard substance, 30 mg (100 ppm)) of aniline was used. When the biodegradation ratio was 60% or more, the test substance was decided to be a good degradable substance. The evaluation number of the test substance was n=2.

As a result of the measurement under the foregoing conditions, the aniline as a biodegradable standard substance showed a biodegradation ratio of 60% or more during the test period and was decided to have good degradability. According to this, it was concluded that the present test system was operated normally.

The biodegradation ratio of the NL/MOL high-concentration group (100 ppm) for 28 days was 88.4% and 86.8%, respectively (average: 87.6%) and the group was decided to have "good degradability".

The biodegradation ratio of the NL/MOL low-concentration group (30 ppm) for 28 days was 100.3% and 97.3%, respectively (average: 98.8%), and the group was decided to have "good degradability".

The biodegradation ratio of the glutaraldehyde high-concentration group (100 ppm) for 28 days was 52.7% and 52.5%, respectively (average: 52.6%), and the group was decided to have "partial degradability (hardly degradable)".

The biodegradation ratio of the glutaraldehyde low-concentration group (30 ppm) for 28 days was 78.5% and 77.5%, respectively (average 78.0%), and the group was decided to have "good degradability".

From the foregoing results, NL and/or MOL have/has low oral toxicity as compared with glutaraldehyde, the results of the toxicity test on algae are good, and the biodegradability is high. Accordingly, it is noted that NL and/or MOL are/is high in safety from the standpoint of environmental and occupational safety as compared with glutaraldehyde.

Test Example 2

<Thermal Stability Test>

A vial bottle was charged with each of the following test solutions, an air space part of which was then purged with nitrogen, and hermetically sealed, followed by storing at 60° C. When an NL/MOL or glutaraldehyde content of each test solution immediately after the start of the storage was defined as 100%, a change in the content at an elapsed time of 5 days, 12 days, and 21 days, respectively was observed according to a calibration curve by means of gas chromatography with an internal standard. The results are shown in Table 5.

Test solution 1: Mixture of NL and MOL (mass ratio: 92/8)

Test solution 2: Mixture of NL/MOL/water=91/7/2 (mass ratio)

Test solution 3: 50% glutaraldehyde aqueous solution (manufactured by Tokyo Chemical Industry Co., Ltd.)

[Gas Chromatography Analysis Conditions]

Analysis instrument: GC-14A (manufactured by Shimadzu Corporation)

Detector: FID (hydrogen flame ionization detector)

Column used: G-300 (length: 20 m, film thickness: 2 μm, inner diameter: 1.2 mm) (manufactured by Chemicals Evaluation and Research Institute, Japan)

Analysis conditions: Inject. Temp. 250° C., Detect. Temp. 250° C.

Temperature rise conditions: 80° C.→(temperature rise at 5° C./min)→230° C.

Internal standard substance: Diglyme (diethylene glycol dimethyl ether)

TABLE 5

Results of thermal stability test

| | 0 day | 5 days later | 12 days later | 21 days later |
|---|---|---|---|---|
| Test solution 1 | 100% | 100% | 99% | 98% |
| Test solution 2 | 100% | 99% | 98% | 98% |
| Test solution 3 | 100% | 96% | 74% | 62% |

*: Calculated based on the content at day 0 as 100%

In the test solution 1 and the test solution 2 each containing NL and MOL, 98% remained even at an elapsed time of 21 days. On the other hand, in the test solution 3 containing glutaraldehyde, the remaining amount was 62% at an elapsed time of 21 days.

Accordingly, it is noted that NL and/or MOL are/is higher in the thermal stability than the glutaraldehyde aqueous solution.

Test Example 3

In order to evaluate corrosiveness of an aldehyde aqueous solution on metals, the following aqueous solutions were prepared.

A: 1% NL/MOL aqueous solution prepared by diluting a mixture of NL/MOL with distilled water B: 1% MGL aqueous solution prepared by diluting MGL with distilled water C: 1% glutaraldehyde aqueous solution prepared by diluting a 50% glutaraldehyde aqueous solution (manufactured by Wako Chemical Industries, Ltd.) with distilled water D: 1% glyoxal aqueous solution prepared by diluting a 40% glyoxal aqueous solution (manufactured by Tokyo Chemical Industry Co., Ltd.) with distilled water E: Distilled water (blank)

Five 50-mL screw tubes were charged with a test piece of SS400 (20 mm×20 mm×2 mm) and 25 g of each of the aldehyde aqueous solutions A to D at atmospheric pressure, hermetically sealed, and then stored within a circulation-type dryer set at 85° C. for 9 days. After completion of the storage, the test piece was taken out, and an iron ion concentration in the aqueous solution was measured by the atomic absorption method. The results are shown in Table 6.

Test Example 4

The same procedures as in Test Example 3 were followed to measure an iron ion concentration in each of the aqueous solutions, except that in Test Example 3, the hermetic sealing was performed under nitrogen. The results are shown in Table 6.

TABLE 6

Results of corrosiveness test

| | Iron ion concentration (ppm) | |
|---|---|---|
| Aldehyde aqueous solution | Test Example 3 | Test Example 4 |
| A (1%-NL/MOL) | 516 | 17 |
| B (1%-MGL) | 471 | 762 |
| C (1%-glutaraldehyde) | 2079 | 449 |
| D (1%-glyoxal) | 3273 | 2450 |
| E (Blank) | 471 | 31 |

From the results of Test Example 3 and Test Example 4, it is noted that in the NL/MOL aqueous solution and the MGL aqueous solution, the corrosion of iron is inhibited as compared with the glutaraldehyde aqueous solution and the glyoxal aqueous solution.

The invention claimed is:

1. A method for removing a sulfur-containing compound in a hydrocarbon, the method comprising contacting the hydrocarbon with a composition consisting of 1) 1,9-nonanedial, 2-methyl-1,8-octanedial, or both; 2) optionally, a solvent selected from water, toluene, xylene, heavy aromatic naphtha, petroleum distillate, or a monoalcohol or diol having 1 to 10 carbon atoms; and 3) optionally, a nitrogen-containing compound selected from α-amino ether compounds, alkoxy-hexahydrotriazine compounds, alkyl-hexahydrotriazine compounds, hydroxyalkyl-hexahydrotriazine compounds, monoamine compounds, diamine compounds, reaction products between an alkylenepolyamine and formaldehyde, quaternary ammonium salt compounds, imine compounds, imidazoline compounds, hydroxyaminoalkyl ether compounds, morpholine compounds, pyrrolidone compounds, piperidone compounds, alkylpyridine compounds, 1H-hexahydroazepine, polyvalent metal chelate compounds of an aminocarboxylic acid, polyethyleneimine, polyallylamine, polyvinylamine, amino carbinol compounds, aminal compounds, and bisoxazolidine compounds, wherein the sulfur-containing compound is hydrogen sulfide, an —SH group-containing compound, or a mixture thereof.

2. The method according to claim 1, comprising further contacting the hydrocarbon with a nitrogen-containing compound.

3. The method according to claim 1, wherein the hydrocarbon is one or more selected from the group consisting of natural gas, liquefied natural gas, sour gas, crude oil, naphtha, heavy aromatic naphtha, gasoline, kerosene, diesel oil, light oil, heavy oil, FCC slurry, asphalt, and an oil field concentrate.

4. The method according to claim 1, wherein an amount of the composition is from 1 to 10,000 ppm relative to a mass of the hydrocarbon.

5. The method according to claim 1, wherein the composition and the hydrocarbon are brought into contact with each other at a temperature of from 20° C. to 200° C.

6. A method for removing a sulfur-containing compound in a hydrocarbon, the method comprising contacting the hydrocarbon with a composition consisting of 1) 3-methylglutaraldehyde; 2) optionally, a solvent selected from water, toluene, xylene, heavy aromatic naphtha, petroleum distillate, or a monoalcohol or diol having 1 to 10 carbon atoms; and 3) optionally, a nitrogen-containing compound selected from α-amino ether compounds, alkoxy-hexahydrotriazine compounds, alkyl-hexahydrotriazine compounds, hydroxyalkyl-hexahydrotriazine compounds, monoamine compounds, diamine compounds, reaction products between an alkylenepolyamine and formaldehyde, and quaternary ammonium salt compounds, imine compounds, imidazoline compounds, hydroxyaminoalkyl ether compounds, morpholine compounds, pyrrolidone compounds, piperidone compounds, alkylpyridine compounds, 1H-hexahydroazepine, polyvalent metal chelate compounds of an aminocarboxylic acid, polyethyleneimine, polyallylamine, polyvinylamine, amino carbinol compounds, aminal compounds, and bisoxazolidine compounds, wherein the sulfur-containing compound is hydrogen sulfide, an SH group-containing compound, or a mixture thereof.

7. The method according to claim 6, comprising further contacting the hydrocarbon with a nitrogen-containing compound.

8. The method according to claim 6, wherein the hydrocarbon is one or more selected from the group consisting of natural gas, liquefied natural gas, sour gas, crude oil, naphtha, heavy aromatic naphtha, gasoline, kerosene, diesel oil, light oil, heavy oil, FCC slurry, asphalt, and an oil field concentrate.

9. The method according to any of claim 6, wherein an amount of the composition is from 1 to 10,000 ppm relative to a mass of the hydrocarbon.

10. The method according to any of claim 6, wherein the composition and the hydrocarbon are brought into contact with each other at a temperature of from 20° C. to 200° C.

* * * * *